US006086025A

United States Patent [19]

Hörmann

[11] Patent Number: 6,086,025

[45] Date of Patent: Jul. 11, 2000

[54] SPECIALLY DESIGNED RAIL FOR MOUNTING A TENSIONING DEVICE

[75] Inventor: Michael Hörmann, Halle, Germany

[73] Assignee: Marantec Antriebs-und Steuerungstechnik GmbH & Co. Produktions KG, Marienfeld, Germany

[21] Appl. No.: 09/063,330

[22] Filed: Apr. 20, 1998

[30] Foreign Application Priority Data

Apr. 21, 1997 [DE] Germany ..... 297 07 151 U

[51] Int. Cl.[7] ..... A45D 19/04

[52] U.S. Cl. ..... 248/127; 248/423; 248/157; 160/191; 160/192

[58] Field of Search ..... 248/295.11, 157, 248/423, 429, 127; 160/192, 191

[56] References Cited

U.S. PATENT DOCUMENTS

| | | | |
|---|---|---|---|
| 3,460,794 | 8/1969 | Colautti | 248/423 |
| 4,878,529 | 11/1989 | Hormann | 160/201 |
| 5,577,544 | 11/1996 | Carper et al. | 160/191 |
| 5,785,292 | 7/1998 | Muraishi et al. | 248/429 |
| 5,797,575 | 8/1998 | Clausen | 248/429 |
| 5,902,013 | 5/1999 | Hong | 297/383 |
| 5,918,846 | 7/1999 | Garrido | 248/429 |

*Primary Examiner*—Ramon O. Ramirez
*Assistant Examiner*—Walter Landry
*Attorney, Agent, or Firm*—Dilworth & Barrese

[57] ABSTRACT

This invention concerns a specially designed rail for mounting a tensioning device in which a mount for its guide component can be positioned at various areas of the rail. Pursuant to the invention, the rail has a row of cut-outs in the area of the mount and rows of projections in the direction of the mount.

6 Claims, 2 Drawing Sheets

SPECIALLY DESIGNED RAIL FOR MOUNTING A TENSIONING DEVICE

BACKGROUND OF THE INVENTION

The invention concerns a a specially designed rail for mounting a tensioning device with rails, where a mount for the guide component can be positioned in various areas of the rail.

Generic tensioning devices of various methods of embodiment are used, for example, in gate drives, such as industrial gates or garage doors. Such types of gates are driven by means of a pinion driven by a motor with gears, via which the drive is guided and which serves as the first guide component. The drive here is preferably designed as an endless synchronous belt or chain. At a distance from the powered pinion, there is a rotatable second guide component that is generally designed as a roller or may also be a pinion. In the ready-to-operate status, the drive component runs over both guide components and transfers the rotational motion of the drive pinion into the translational direction required for opening and closing the gate. A catch is mounted to the drive component in a preferably detachable manner; it follows the motion of the drive and causes the movement of the gate by means of a rod assembly connected to the gate. Drive and catch generally run on a rail attached to a bay or garage ceiling, the end ranges of which are provided with mounts for the guide components.

Since a minimum tension on the drive component is necessary for problem-free, quiet operation of the gate drive, the spacing of the drive pinion and the second guide component, which establish the end points of the drive as laid out and thus impact the tension on the drive, is of great importance. Tensioning devices are known for such drives with which the position of one or more mounts for the guide components and thus the position of the guide components themselves can be altered continuously by means of an adjusting screw. Such tensioning devices have the disadvantage that a relatively large number of different components are necessary for the mounting and operation. Another disadvantage is that loosening or tightening the adjusting components or screws, with the corresponding tools, is always necessary to change the tension on the drive component when using the generic tensioning device.

SUMMARY OF THE INVENTION

The object of this invention is to create a tensioning device for drives that is easily adjustable and allows for simple mounting.

This task is largely solved by a generic device in that the rails for positive positioning of the mounts for the guide components have one or more cut-outs (40) in the area of the mount and/or one or more (20,30) projections projecting in the direction of the mount. An essential characteristic of the tensioning device pursuant to the invention is that the adjustment of the tension on the drive components is possible by simply displacement of the mount on the rail without having to loosen or displace attachment or adjustment components. If the rail has cut-outs, the corresponding projections are provided on the mount that penetrate the cut-outs in such manner that a positive connection is created between the rails and the mount. Projections may also be provided on the rail that extended in the direction of the mount and penetrate positively into the corresponding cut-outs or hollows in the mount. If the drive component is to be tensioned, the mount is loosened from its original position on the rail and displaced until the projections again penetrate into the corresponding cutouts. Very precise adjustment of the tension on the drive component is possible if the distance between projections and/or cut-outs is small. Drive components of varying length can also be used here since the tensioning device pursuant to the invention enables not only fine positioning but also larger changes in the spacing of the guide components. Since the desired positioning of the guide roller mounts is created by a positive connection with the rail, attachment or tensioning components are not necessary, which considerably simplifies and lessens the expense of the preparation and assembly of the device.

The rail can have cut-outs and/or projections spaced along the longitudinal direction of the rail and/or in a plane perpendicular thereto. The cut-outs and/or projections spaced longitudinally cause a displacement of the guide roller mount in this direction, while the cut-outs and/or projections spaced on a plane perpendicular to the longitudinal direction serve to ensure a secure connection, particularly capable of bearing weight, between the mount and rail in a desired position. The cut-outs and/or projections are spaced such that a weakening of the material that could impair operation of the tensioning device and the gate drive is precluded. If the rail has only cut-outs and/or projections that are spaced in a plane perpendicular to the longitudinal direction of the rail, displacement of the mount on the rail in a longitudinal direction is achieved in that the mount itself has several cutouts and/or projections spaced accordingly. The advantage of this method of embodiment is that the rail is only slightly weakened by the corresponding, relatively low number of cutouts and/or projections.

In another method of embodiment of the invention, provision is made so that the rails have cut-outs and/or projections that are spaced both in a longitudinal direction and in a plane perpendicular thereto. Here, a row of cut-outs and/or projections extend, for example, from the middle section of the rail diagonally toward an edge area. The advantage of this method of embodiment is that a fine adjustment of the tension on the drive is possible without substantially impairing the stability of the rail through the cut-outs and/or projections, which are spaced at correspondingly small distances from each other.

The rail can be designed as a C-profile or a U-profile. The guide roller mounts and the drive and catch can be placed on the profiles such that a secure connection is guaranteed, as is reliable lateral control.

In another method of embodiment of the invention, provision is made such that the rail, embodied as a C profile or a U profile, has cut-outs and/or projections spaced longitudinally in its middle section and/or at the leg parts. This results in the advantage that the mount can be fixed in a desired position on several sides of the rail, creating a particularly secure connection.

Pursuant to a preferred method of embodiment of this invention, the rail designed as a C profile or U profile has cut-outs and/or projections in its middle section and/or at the leg parts that are spaced in a plane perpendicular to the longitudinal direction. This results in several cut-outs and/or projections penetrating at the desired position for the mount, thus preventing undesired displacement of the mount. To position the mount at various positions, the mount in turn must have several cut-outs and/or projections spaced along the longitudinal direction of the rail; it does not matter here whether the cut-outs or the projections are on the mount or on the rail. This method of embodiment has the advantage that the cut-outs and/or projections on the mount can be manufactured by extruding plastic, resulting in a substantially simpler production for the rails with correspondingly few cutouts and/or projections. Furthermore, the rail is highly stable in this case, due to the low number of cut-outs and/or projections.

In another method of embodiment of this invention, provision is made so that the projections are designed as flexible clips. They extend from the rail in the direction of the positionable mount, or starting from the mount in the direction of the cut-outs on the rail. The clips can be produced on the mount by extruding plastic, while the clips on the rail can be produced by punching and bending.

BRIED DESCRIPTION OF THE DRAWINGS

Additional details and advantages of the invention are explained in greater detail based on a method of embodiment shown in the drawings. They show:

FIG. 1 A rail with a C profile and projections in the longitudinal direction of the rail and in a plane perpendicular thereto, and FIG. 2 A rail with a C profile with projections in the plane perpendicular to the longitudinal direction of the rail.

DESCRIPTION OF THE PREFERRED EMBODIMENT

Figure 1:
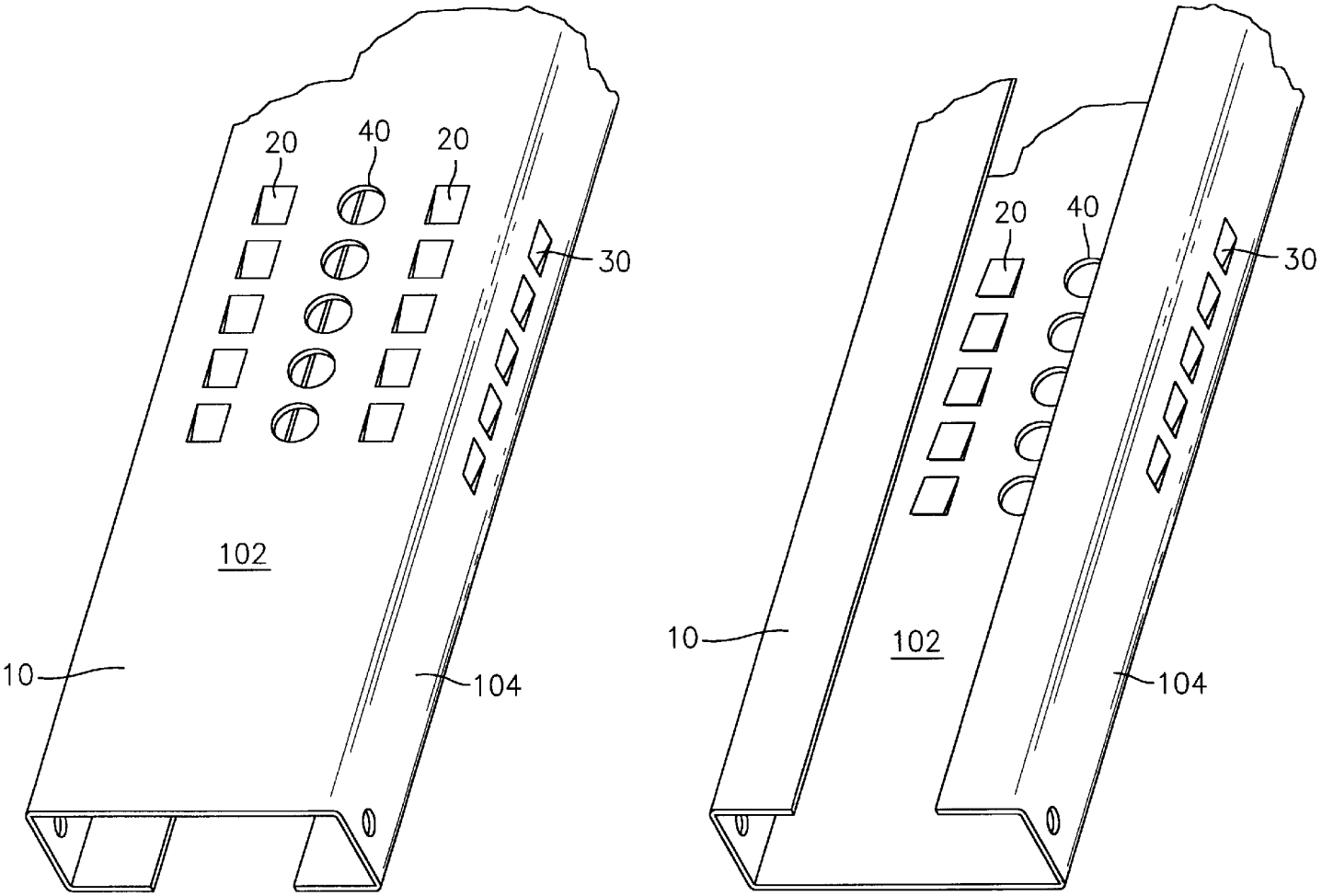

FIG. 1 shows rail 10 with a C profile that has projections 20, 30 in its middle section 102 as well as on leg parts 104, spaced in the longitudinal direction of the rail and in a plane perpendicular thereto. Rail 10 is attached to a bay ceiling or garage ceiling, and the upper portion of middle part 102, shown on the left in FIG. 1, is oriented toward the ceiling. Rail 10 accepts the guide roller mounts, the drive and catch in the C profile. For secure attachment of the mount (not shown in the drawing), it has cut-outs at positions spaced in the circumferential direction, into which projections 20, 30 of rail 10 penetrate at the desired position for the mount. If the tension on the drive component is to be changed or if the drive component is to be replaced, the mount is, for example, loosened from the topmost projections 20, 30, shown on the left in FIG. 1, in order to be attached by means of projections 20, 30 oriented toward the end of rail 10, depending on the desired tension. Here, the mount is drawn to the end of rail 10, as shown in FIG. 1, to the point at which a new series of projections 20, 30 penetrate into the cut-outs in the mount. Displacement of the mount is also possible in a direction opposite thereto when projections 20, 30 are pressed down during displacement in the direction of the exterior of the C profile.

Figure 2:
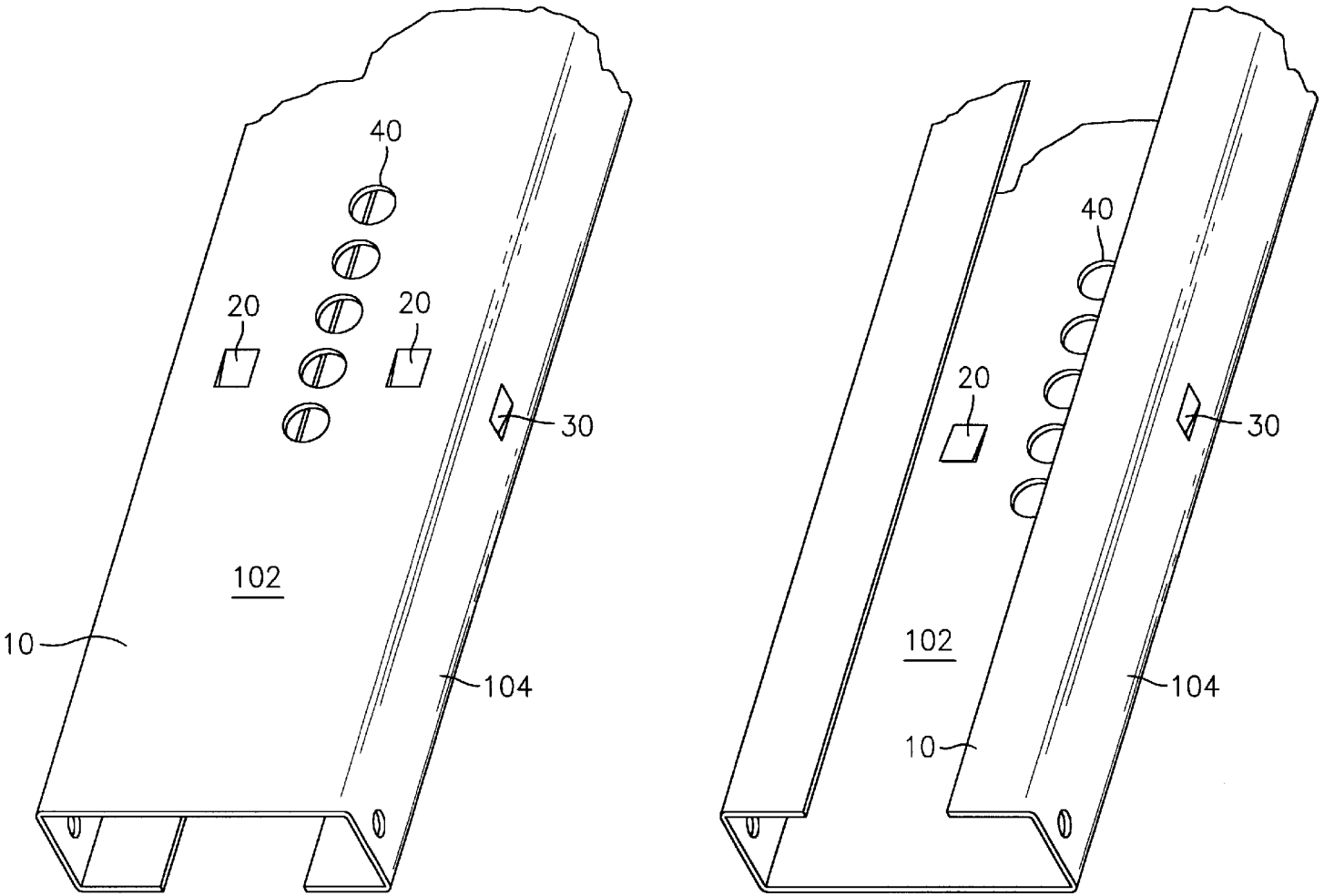

FIG. 2 shows a method of embodiment of this invention in which projections 20, 30 are placed on rail 10 in its middle section 102, as well as on leg parts 104. Projections 20, 30 are, however, not spaced in the longitudinal direction of rail 10, but rather in a plane perpendicular to the longitudinal direction. This results in the fact that the manufacture of the rail is made relatively simple, for one thing, and only a slight weakening of the material occurs, for another. Rail 10 shown in FIG. 2 also accepts the mount (not shown) as well as the drive component and catch. Displacement of the mount in the longitudinal direction of rail 10 in this case however, is not possible when the mount can be accepted in various projections 20, 30 spaced in the longitudinal direction, but rather only when the mount itself has cut-outs spaced in a longitudinal direction. If the mount is displaced from a first position to a second, projections 20, 30 are released from the cut-outs and finally penetrate in new cut-outs in the mount spaced in the longitudinal direction.

What is claimed is:

1. A rail (10) for mounting and positioning a drive guided by a drive component whereby a mount for the guide component can be positioned in various locations on the rail (10), in which said rail (10) comprises a middle portion (102) and pair of leg parts (104), said middle portion (102) has a row of cutouts (40) extending substantially along the longitudinal axis of said rail (10) with two rows of projections (20) extending in a longitudinal direction along respective sides of the cutouts (40) and additional rows of projections (30) extending in a longitudinal direction along said leg parts (104).

2. A rail (10) in accordance with claim 1, in which said rail is essentially U-shaped or C-shaped.

3. A rail (10) in accordance with claim 1, in which said projections (20,30) integral with said rail (10) are designed as flexible clips produced by punching and bending.

4. A rail (10) for mounting and positioning a drive guided by a guide component whereby a mount for the guide component can be positioned in various locations on the rail (10) in which said rail (10) comprises a middle portion (102) and a pair of leg parts (104), said middle portion (102) has a row of cutouts (40) extending substantially along the longitudinal axis of said rail (10) and a row of projections (20,30) extending in a direction substantially perpendicular to the longitudinal axis of said rail (10) and upon said middle portion (102) and leg parts (104).

5. A rail (10) in accordance with claim 4, which said rail (10) is essentially U-shaped or C-shaped.

6. A rail (10) in accordance with claim 4, in which said projections (20,30) integral with said rail (10) are designed as flexible clips produced by punching and bending.

* * * * *